US005745935A

United States Patent [19]

Arft

[11] Patent Number: 5,745,935

[45] Date of Patent: May 5, 1998

[54] SINUOUS WIRE SEAT SECTION SOFA SLEEPER

[75] Inventor: Dennis E. Arft, Joplin, Mo.

[73] Assignee: L&P Property Management Co., South Gate, Calif.

[21] Appl. No.: 892,327

[22] Filed: Jul. 14, 1997

[51] Int. Cl.[6] ..... A47C 17/23

[52] U.S. Cl. ..... 5/13; 5/29

[58] Field of Search ..... 5/13, 28, 29, 36

[56] References Cited

U.S. PATENT DOCUMENTS

| | | | |
|---|---|---|---|
| 936,589 | 10/1909 | Warner . | |
| 1,058,934 | 4/1913 | Andren . | |
| 1,248,702 | 12/1917 | Percival . | |
| 1,260,600 | 3/1918 | Usievich . | |
| 1,296,612 | 3/1919 | Bartlett . | |
| 1,306,756 | 6/1919 | Fischrupp . | |
| 1,351,011 | 8/1920 | Brilliant . | |
| 1,374,661 | 4/1921 | Hubbert . | |
| 1,527,416 | 2/1925 | Konrad . | |
| 2,235,554 | 3/1941 | Hopkes et al. . | |
| 2,241,552 | 5/1941 | Hopkes et al. . | |
| 2,634,427 | 4/1953 | Wodarsky . | |
| 2,742,653 | 4/1956 | Woller . | |
| 2,749,559 | 6/1956 | Petersen . | |
| 2,770,814 | 11/1956 | Schindler . | |
| 2,812,523 | 11/1957 | Laemmle . | |
| 2,818,583 | 1/1958 | Nowell et al. . | |
| 2,823,389 | 2/1958 | Coopersmith . | |
| 2,851,698 | 9/1958 | Barabas et al. . | |
| 2,878,490 | 3/1959 | Schneider . | |
| 2,947,006 | 8/1960 | Coopersmith . | |
| 2,985,892 | 5/1961 | Garrigus, Sr. et al. . | |
| 3,002,198 | 10/1961 | Kaiser, Jr. . | |
| 3,030,147 | 4/1962 | Kinnebrew . | |
| 3,098,244 | 7/1963 | Rothbauer, Jr. . | |
| 3,237,213 | 3/1966 | Birgbauer, Sr. . | |
| 3,247,526 | 4/1966 | Rogers, Jr. | 5/13 |
| 3,258,786 | 7/1966 | Rea . | |
| 3,284,812 | 11/1966 | Koch . | |
| 3,317,929 | 5/1967 | Beaume et al. . | |
| 3,325,831 | 6/1967 | Crosby et al. . | |
| 3,380,082 | 4/1968 | Mikos | 5/13 X |
| 3,431,567 | 3/1969 | Spitz et al. | 5/13 X |
| 3,740,775 | 6/1973 | Metayer . | |
| 3,797,886 | 3/1974 | Griffiths . | |
| 3,854,153 | 12/1974 | Fadler et al. . | |
| 3,872,523 | 3/1975 | Garza . | |
| 3,994,482 | 11/1976 | Platt et al. . | |
| 4,067,073 | 1/1978 | Komarov . | |
| 4,104,745 | 8/1978 | Facitti . | |
| 4,136,411 | 1/1979 | Fanti . | |
| 4,222,134 | 9/1980 | Degen . | |
| 4,381,570 | 5/1983 | Schneider . | |

(List continued on next page.)

FOREIGN PATENT DOCUMENTS

| | | |
|---|---|---|
| 688397 | 6/1964 | Canada . |
| 954344 | 4/1964 | United Kingdom . |
| 2091092 | 7/1982 | United Kingdom . |

*Primary Examiner*—Michael F. Trettel
*Attorney, Agent, or Firm*—Wood, Herron & Evans, L.L.P.

[57] ABSTRACT

A sofa sleeper foldable sofa bed assembly having pivotally interconnected head, body, intermediate and foot frame sections which are extendable to form a bed and foldable to form a sofa seat. Each frame section has a pair of opposed side rails and the head and foot frame sections have end rails connecting the opposed side rails. The frame further comprises a cross rail extending between opposed side rails of the intermediate frame section. In one preferred embodiment, a floating cross tube is spaced from and generally parallel the cross rail. The floating cross tube has two ends, each end of which is secured to the cross rail by a rigid wire hook. A plurality of transversely spaced longitudinally extending sinuous wire springs extend between the cross rail and the end rail of the foot section of the frame in one embodiment of this invention and between the floating cross tube and the end rail of the foot frame section in a second embodiment of the invention. The floating cross tube enables the sinuous wire springs to be stretched and become more rigid when the frame sections are folded into a sofa seat then when the frame sections are extended in a bed position.

13 Claims, 5 Drawing Sheets

U.S. PATENT DOCUMENTS 4,504,987 3/1985 Spitz ..... 5/29 X
4,523,342 6/1985 Poovey .
4,541,133 9/1985 Reiss et al. .
4,584,727 4/1986 Reiss et al. .
4,754,505 7/1988 Mizelle .
5,305,479 4/1994 Robinson .
5,414,871 5/1995 Steven ..... 5/13
5,450,637 9/1995 Hanes et al. ..... 5/13
5,524,305 6/1996 Miller .
5,539,940 7/1996 Miller .
5,539,944 7/1996 Miller .
5,540,418 7/1996 Miller .

SINUOUS WIRE SEAT SECTION SOFA SLEEPER

FIELD OF THE INVENTION

This invention relates to a sofa sleeper foldable sofa bed assembly of the type which may be collapsed and hidden in the bottom of a sofa and extended outwardly into a bed.

BACKGROUND OF THE INVENTION

Foldable sofa sleepers having pivotally interconnected head, body, intermediate and foot sections movable between a fully folded or retracted position within a sofa frame for use as a seat and an extended unfolded position for use as a bed are known in the art. Prior foldable sofa sleepers are typically characterized by a relatively poor sleeping surface and a less than desirable seating surface. Most prior sofa sleepers represent a compromise between a good bed and a good sofa in that no matter how well constructed, they are not as good for sleeping as most beds and are not as good for seating as most sofas. Poor sleeping quality can be attributed to the provision of a poor foundation beneath the mattress and poor seating quality stems from the same problem, a lack of firm foundation beneath the seat cushions.

Most sofa sleepers employ a wire fabric material or a sheet of woven polypropylene or other plastic material which extends between the side rails of the head, body, intermediate and foot sections of the sofa bed frame for support of a foldable mattress. Wire fabric alone or plastic sheeting alone has proven to be unsatisfactory in providing sufficient support for both the mattress and seat cushions of the sofa sleeper. The mattress support sags excessively when the frame is unfolded for use as a bed and provides inadequate support when folded up and used as a seat.

In an effort to provide a better foundation beneath the mattress and beneath the seat cushions, attempts have been made to reinforce the wire fabric or plastic sheeting in all of the frame sections and particularly the body frame section of the sofa bed fixture where most of the weight is applied in using the sofa sleeper as a bed. Supports have been positioned beneath the fabric or plastic sheeting material in the area of the body frame section to help prevent sagging. U.S. Pat. No. 5,305,479 issued to the assignee of the present invention, the disclosure of which is incorporated by reference herein, discloses a plurality of sinuous springs extending between cross members or cross ties mounted to the side rails of the body frame section in order to prevent sagging of the mattress supporting fabric or plastic sheeting material in the body frame section.

When the sofa sleeper is folded up into its sofa position, the foot frame section of the bed becomes the seating surface of the sofa and the material between the side rails of the foot frame section receives the weight of a person sitting on the sofa. Wire fabric or plastic sheeting has proven to be less than optimal as such a seating surface and may even rip or tear with repeated use.

U.S. Pat. No. 4,584,727 discloses a sofa bed having a foldable bed frame with a plurality of sinuous spring wires attached to and extending between two parallel cross members in the foot section of the bed frame. When the bed frame is collapsed into a sofa, the sinuous wires of the foot section form a seating surface of a sofa overlying the body supporting section. The sinuous wires extend between the front and back of the sofa seat at right angles to the back of the sofa and are transversely spaced across the width of the seat. Incorporating sinuous springs into the foot section of a foldable sofa bed enables the seating surface of the sofa to be firmer than if fabric or some other type of material were used as the foot section of the bed. The distance between the cross members in the foot section of the bed frame of the sofa sleeper disclosed in this patent does not change when the bed is folded up into a sofa and back, hence, the amount of tension of the sinuous wires does not change regardless of whether the foldable bed frame is extended in a bed position or collapsed in a sofa position. Therefore, although the degree of tension of the sinuous wire springs is adequate to support a mattress when the frame sections are extended into a bed, the same degree of tension may be excessively soft when the frame sections are folded into a sofa and the foot section of the frames becomes the seating surface of the sofa.

Therefore, it has been one objective of the present invention to provide a foldable sofa sleeper sofa bed assembly incorporating sinuous springs in the foot section of the bed frame which are capable of providing an adequately firm seating surface when the frame sections are folded into a sofa.

It has been a further objective of the present invention to provide a sofa sleeper foldable sofa bed assembly having a mechanism capable of changing the tension of the sinuous wires comprising the foot section of the assembly in order to prolong the useful life of the sinuous wires.

It has been a further objective of the present invention to provide a plurality of sinuous springs in the foot section of a sofa sleeper foldable sofa bed which are adapted to be removably inserted in one or more cross ties extending between side rails of the foot frame section of the sofa bed assembly without being affixed to the body supporting section of the assembly and without any tendency to inadvertently slip from connection to the cross ties.

SUMMARY OF THE INVENTION

The invention of this application which accomplishes these objectives comprises a sofa sleeper foldable sofa bed assembly having pivotally interconnected head, body, intermediate and foot frame sections. Each frame section comprises a pair of opposed side rails. The head and foot frame sections each have an end rail connecting the opposed side rails. The intermediate frame section has a cross rail extending between the opposed side rails of the intermediate frame section. The frame sections extend outwardly to form a bed and are foldable to form a sofa seat. The frame sections may be folded into a stationary wooden sofa frame to form the seating surface of a sofa.

In one preferred embodiment, the sofa bed assembly further comprises a floating cross tube spaced from and generally parallel the cross rail. The floating cross tube has two ends, each end being secured to the cross rail with a wire hook. Each wire hook has two arcuate ends, one being inserted into a hole in the cross rail and the other being inserted into a hole in one end of the floating cross tube.

A plurality of transversely spaced longitudinally extending sinuous wire springs are connected to the floating cross tube and the end rail of the foot frame section. A plurality of straight wires interconnect adjacent sinuous wire springs and provide additional support preventing the sinuous springs from separating too far from one another. One purpose of the floating cross tube is to enable the sinuous springs to lengthen when the foldable frame sections are folded into the sofa position increasing the tension on the sinuous springs and increasing the firmness of the sofa's seating surface. The floating cross tube further provides additional seating support and forms part of the seat surface when the frame sections are folded inwardly to their collapsed sofa position.

When the frame sections are in an extended bed position, the floating cross tube is located slightly in front of the cross rail and between the cross rail and the end rail of the foot frame section. Conversely, when the frame sections are folded into the sofa position, the floating cross tube is located rearwardly of the cross rail and provides additional support for a person sitting on the sofa.

A second embodiment of the present invention does not utilize a floating cross tube. Rather, a plurality of sinuous wire springs extend between the cross rail and the end rail of the foot frame section. Each sinuous wire spring has a first substantially planar hook at one end of the sinuous wire spring engaged with the cross rail and a second substantially planar hook at the other end of the sinuous wire spring engaged with the end rail of the foot frame section. The planar hooks of each sinuous spring are located in mutually perpendicular planes such that when the frame sections are extended, the first hook is substantially vertically oriented and inserted through a hole in the top of the cross rail and the second hook is substantially horizontally oriented and inserted through a hole in the sidewall of the end rail of the foot frame section. When the frame sections are folded with the intermediate frame section being substantially vertically oriented, the first substantially planar hook at one end of the sinuous wire spring engaged with the cross rail maintains its vertical orientation and the second substantially planar hook at the other end of the sinuous wire spring engaged with the end rail of the foot frame sections maintains its substantially horizontal position. Due to the configuration of the cross rail, the end rail of the foot frame section and the sinuous spring ends inserted through a hole in one of these members, the sinuous wire springs are not unnecessarily or unduly strained and the foot frame section of the sofa bed assembly is able to fold inwardly without the sinuous wire springs becoming inadvertently separated from either the cross rail or end rail so that the assembly can be made into a sofa from a bed.

DETAILED DESCRIPTION OF THE DRAWINGS

Figure 1:
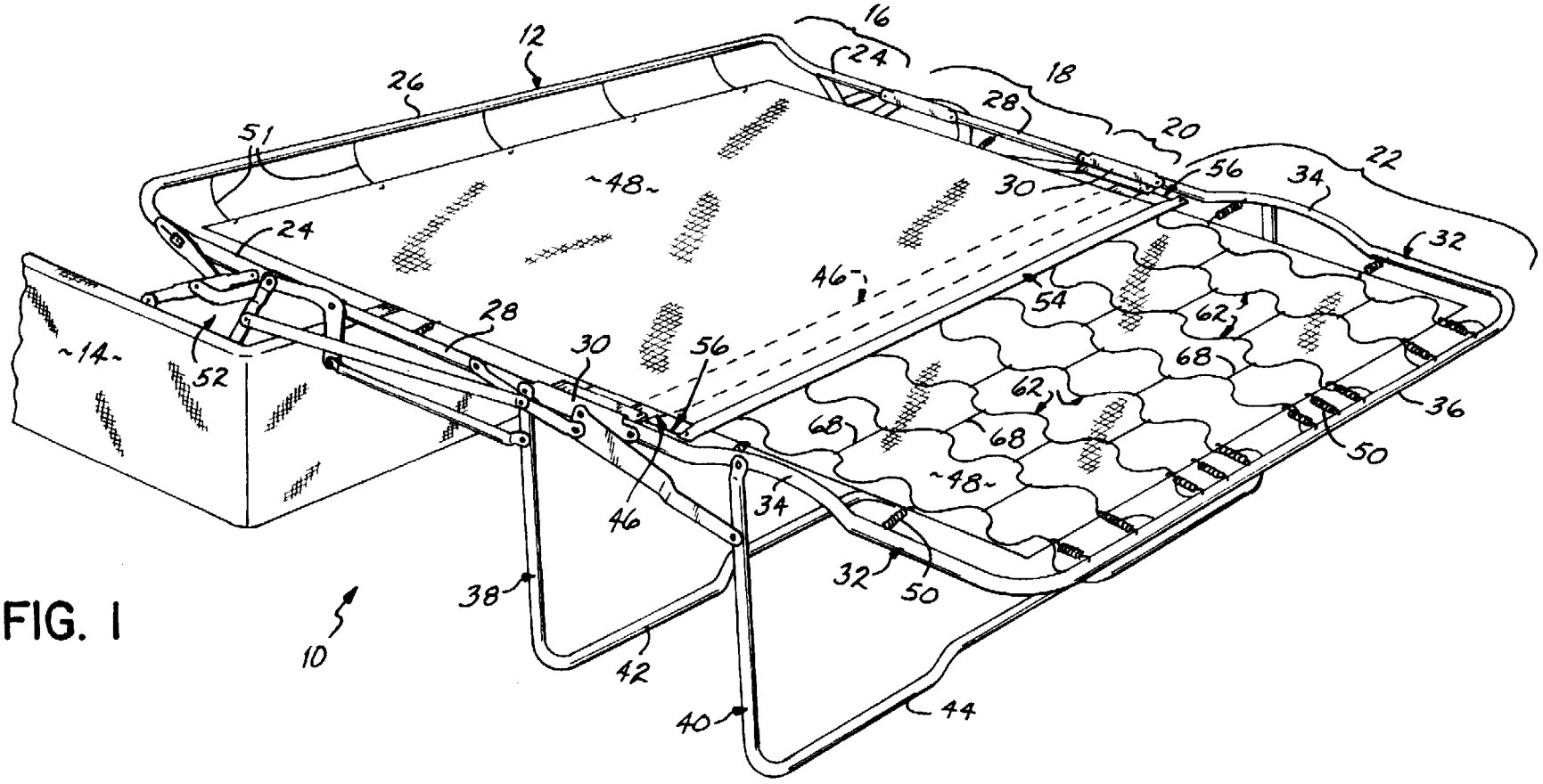
FIG. 1 is a perspective view of the sofa bed assembly of the present invention extended outwardly in the bed position.

Referring to the drawings and particularly to FIG. 1, there is illustrated a sofa sleeper assembly 10 of the present invention including a foldable sofa sleeper frame 12 mounted upon a conventional sofa frame 14. The sofa frame 14 which may be wooden or made of any other material does not form part of the invention of this application and comprises any well known standard frame. The connection between the sofa sleeper assembly 10 and the sofa frame 14 may be any conventional mechanism and again does not form part of the invention of this application. For purposes of this application, the terms front and forward end of the bed references that direction which is toward the front end of the unfolded bed (to the right in FIG. 1) while the terms rear or rearward as used in this application refer to the direction which is toward the head end of the unfolded bed or to the left as seen in FIG. 1.

The foldable sofa sleeper frame 12 comprises a rear head section 16, a body supporting section 18 pivotally connected at one end to the head section 16, a short intermediate section 20 pivotally connected at one end to the other end of the body section 18, and a front foot section 22 pivotally connected at the other end of the intermediate section 20. The head section 16 comprises similarly symmetrical disposed left and right side rails 24 which are connected with a rear end rail 26. The body section 18, the intermediate section 20 and the foot section 22 each comprise similarly disposed left and right side rails 28, 30, and 32 respectively. Side rails 32 of the foot frame section 22 are illustrated as having an arcuate portion 34 which curves upwardly when the assembly is in the bed position with the frame sections extended. An end rail 36 connects the opposed side rails 32 of the foot frame section 22 and serves as the frontmost edge of the frame 12 of the sofa bed assembly 10 when the assembly is in the bed position.

The pivotally connected bed frame sections 16, 18, 20 and 22 are supported in their extended position by a pair of foldable center support legs 38 pivotally connected at their upper ends to the back end of the side rails 30 of the intermediate frame section 20 and a pair of foot section supporting legs 40 pivotally connected at their upper ends to the side rails 32 of the foot frame section 22. The legs 38 are connected by a first bottom bar 42 and legs 40 are interconnected by a second bottom bar 44 respectively. Both the first and second bottom bars 42, 44 rest on the floor when the frame sections are extended and the sofa bed assembly is in its bed position. When the frame sections are folded into the sofa position, legs 40 and bottom bar 44 come forwardly and legs 38 and bottom bar 42 pivot rearwardly in order to enable the frame sections to fold into the sofa position.

Figures 2, 3, 4, 6:
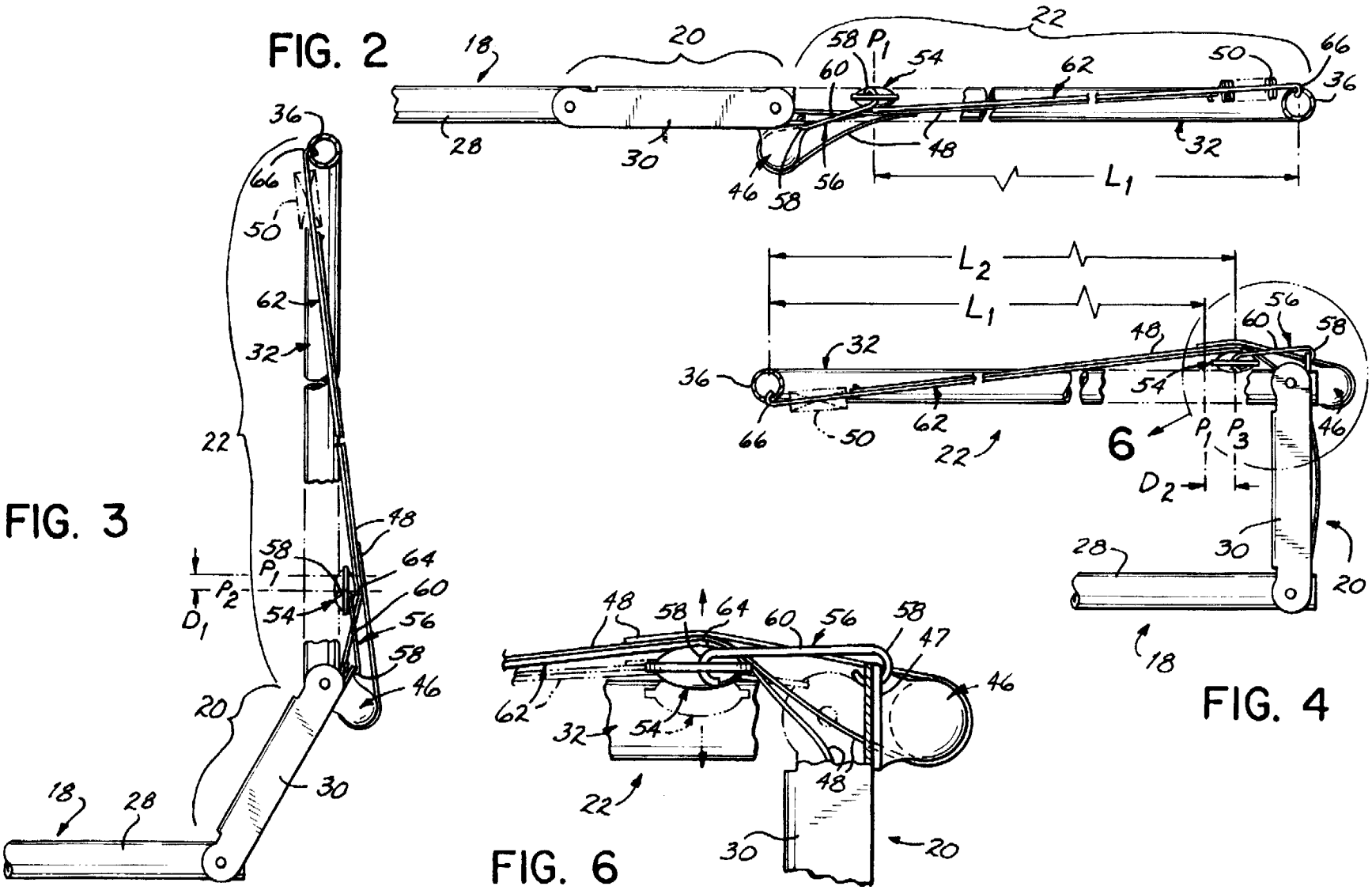
FIG. 2 is a side elevational view of the body, intermediate and foot frame sections extended in the bed position.
FIG. 3 is a side elevational view of the frame sections of FIG. 2 shown in a position between the extended bed position and the foldable sofa position.
FIG. 4 is a side elevational view of the frame sections of FIG. 2 folded into a seat position.
FIG. 6 is an enlarged side elevational view of encircled area 6 of the connection between the foot frame and intermediate sections of FIG. 4.
Figure 5:
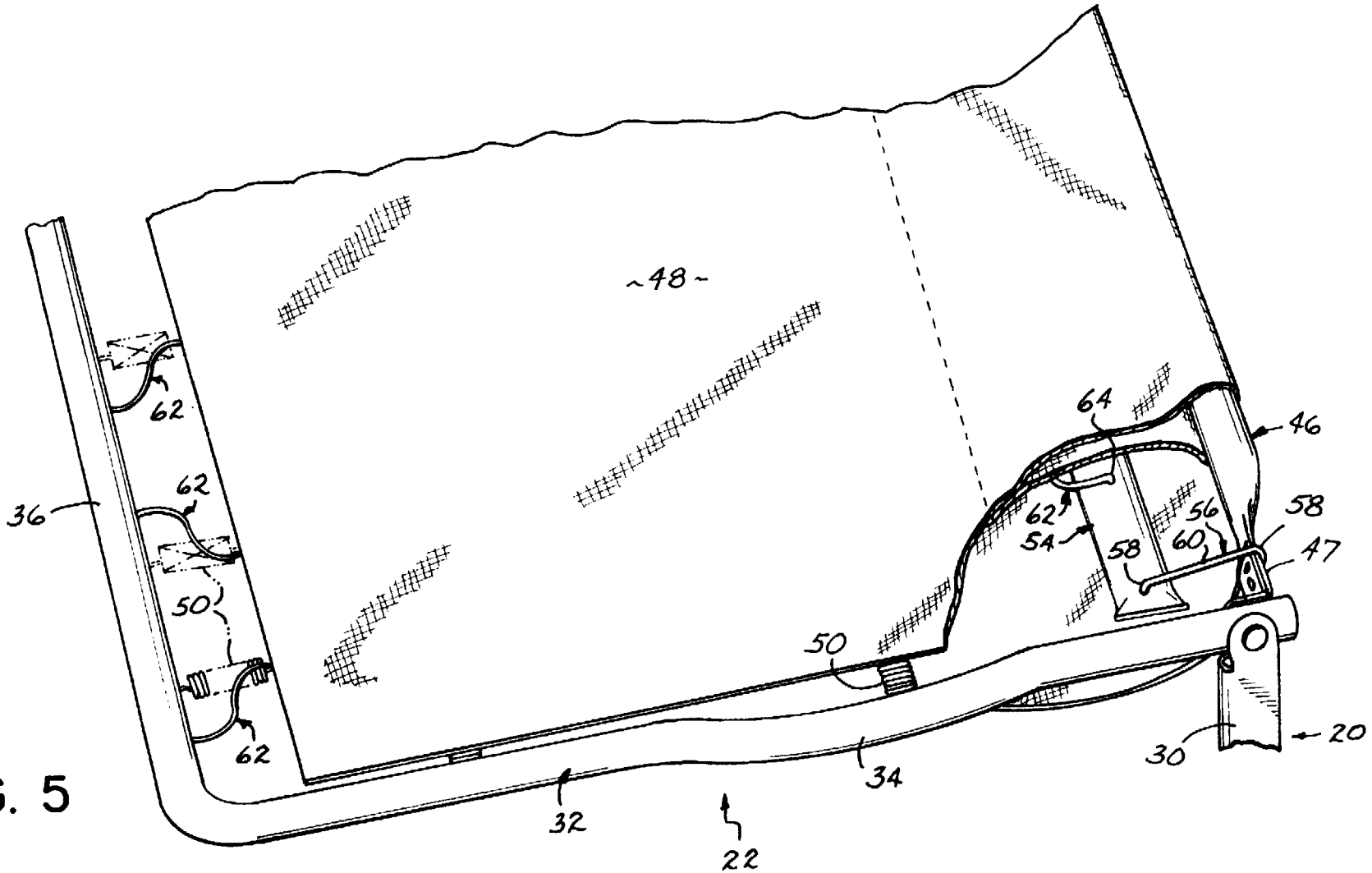
FIG. 5 is a fragmentary perspective view partially broken away of the foot frame section and intermediate section of the foldable sofa bed assembly of FIG. 1 when the frame sections are folded into a seat position.

A cross rail 46 extends between the opposed side rails 30 of the intermediate frame section 20 at the forward edge of the intermediate frame section side members or rails 30. The cross rail 46 is generally parallel the end rails 26 and 36 respectively and has flattened ends 47 as best illustrated in FIGS. 5 and 6. Between the flattened ends 47 of the cross rail 46, the cross rail is generally bulbous in cross section but may be of any shape. Similarly, one or more additional cross rails (not shown) may extend between the opposed side rails 28 of the body supporting section 18 of the frame in order to provide additional support for a person lying on the bed when the frame sections are extended.

The opposed side rails of the head, body supporting, intermediate and foot sections form a rigid bed frame when extended as illustrated in FIG. 1 and a rigid seating frame when retracted as partially shown in FIG. 4. A continuous section of fabric material 48 or a sheet of woven polypropylene or other similar plastic material is resiliently connected to the side frame members 24, 28, 30, 32 of frame sections 16, 18, 20 and 22 by coil springs 50 to provide a mattress supporting surface for seating and sleeping. The continuous section of fabric material 48 is illustrated as extending substantially the entire length of the frame but alternatively, the fabric material 48 may only extend from the head section 16 to the intermediate frame section 20 with coil springs 50 securing fabric material 48 to the side frame members 24, 28 and 30 and to the cross rail 46 rather than the front end rail 36. Arcuate wires 51 are shown as fixedly securing fabric material 48 to end rail 26 but coil springs 50 may be used as well. Alternatively, any other type of material such as a wire grid frame may extend from the proximate rear end rail 26 to proximate the cross rail 46 and be secured to the rear end rail 26, cross rail 46 and side rails 24, 28 of the head and body frame sections by any number of known methods.

In order to support the sofa sleeper frame 12 for controlled collapsing movement into the sofa frame 14, there is a linkage system, generally designated by the numeral 52, which extends between and interconnects the sofa frame 14 and the foldable sofa sleeper frame 12. This linkage system 52 per se forms no part of the invention of this application and therefore has not been described in detail herein. A complete description of one such linkage system suitable for use in the practice of this invention is completely described in the assignee's own U.S. Pat. No. 4,253,205, the disclosure of which is incorporated by reference herein. This linkage system 52 not only controls the folding of the foldable sofa sleeper frame 12 and legs 38, 40 into the storage enclosure of the wooden sofa frame 14, but also controls the unfolding of the frame 12 and supporting legs 38, 40 when the sofa is converted from an item of seating furniture, i.e. a sofa, into an item of sleeping furniture, i.e. a bed.

A floating cross tube 54 extends across the width of the frame 12 generally parallel the cross rail 46 and located slightly forwardly thereof when the frame sections 16, 18, 20 and 22 are extended. The floating cross tube 54 has a length shorter than the length of the cross rail 46, is generally hollow, has a plurality of holes therein and has a generally bulbous cross section as best seen in FIGS. 2–4 and FIG. 6. The floating cross tube 54 may take on other shapes and configurations without departing from the spirit of this invention. The floating cross tube 54 is secured to cross rail 46 at the ends of the floating cross tube 54. At each end of the floating cross tube 54 is a hole through which one end of a wire hook 56 passes.

As best illustrated in FIGS. 2–5, each wire hook 56 has an arcuate portion 58 at each end thereof and a straight portion 60 extending between the arcuate portions 58. One arcuate portion 58 passes through a hole in the floating cross tube 54. The other arcuate portion 58 of the wire hook 56 passes through a hole in the cross rail 46. The wire hooks 56 maintain a fixed distance between the floating cross tube 54 and the cross rail 46 without inhibiting the ability of the cross rail 46 and floating cross tube 54 to rotate from the position of FIG. 2 with the sofa bed assembly frame 12 extended in a bed position and the position of FIG. 4 in which the frame 12 is in its sofa position in a substantially U-shaped configuration with the foot frame section 22 spaced above the body supporting section 18. As seen in FIG. 2, the wire hooks 56 are both located with the arcuate portions 58 upwardly turned when the frame sections 16, 18, 20 and 22 are extended in the bed position and the arcuate portions 58 are downwardly turned when the frame is collapsed in its sofa position as seen in FIGS. 4 and 5 with the wire hook being substantially above or on top of a portion of the floating cross tube 54. As illustrated in the sequence of FIGS. 2–4, the distance between the floating cross tube 54 and the cross rail 46 does not change as the sofa bed frame moves from the bed position of FIG. 2 to the sofa position of FIG. 4. The floating cross tube 54 is located forwardly of the cross rail 46 when the frame sections are in the bed position and the floating cross tube 54 is located slightly rearwardly of the cross rail 46 when the frame sections are folded to form a sofa seat.

As best seen in FIG. 1, a plurality of transversely spaced longitudinally extending sinuous wire springs 62 extend between the floating cross tube 54 and the end rail 36 of the foot frame section 22. Each sinuous spring 62 has a first end comprising a substantially planar first hook 64 and a second end comprising a substantially planar second hook 66. The first hook 64 of each sinuous wire 62 is engaged in a hole located in the floating cross tube 54 and the second hook 66 is engaged with a hole in the front end rail 36 of the foot frame section 22. The holes may be located either through the top or bottom of the floating cross tube 54, or through the sides of the floating cross tube 54 when the frame sections are extended. This application does not intend to limit the location of the holes through the floating cross tube 54 or through the front end rail 36.

It should be understood that while eight longitudinally extending sinuous wire springs 62 are shown in the drawings, additional or fewer sinuous springs could be utilized to provide either firmer or less firm support in the foot section of the foldable frame. The floating cross tube 54 and sinuous wires 62 rest above the fabric material 48 so that when the frame sections are foldable into the sofa position as illustrated in FIGS. 4 and 5, the fabric material 48 resides on top of the sinuous wires 62 and floating cross tube 54 thus providing a slightly more comfortable seating surface for the user.

As illustrated in FIGS. 2–4, the floating cross tube 54 defines a transversely extending plane P1 identified in FIG. 2 aligned with the center of the floating cross tube. As illustrated in FIG. 2, each of the sinuous wire springs 62 extends a distance L1, the distance between the plane P1 and the end rail 36 of the foot frame section 22 when the frame sections are extended in their bed position. As the foot frame section 22 is moved upwardly from the bed position of FIG. 2 to the sofa position of FIG. 4, the floating cross tube 54 is pulled away from end rail 36 increasing the tension on the sinuous springs 62. As illustrated in FIG. 3 the plane defined by the middle of the floating cross tube 54 is moved to a position P2. Note that the distance between the floating cross tube 54 and the cross rail 46 does not change due to the rigidity of the two wire hooks 56 located at the ends of the floating cross tube 54 connecting the floating cross tube 54 to the cross rail 46. The distance the floating cross tube 54 has moved relative to end rail 36 is identified in FIG. 3 as D1.

As illustrated in FIG. 4, when the foldable frame sections are folded into the sofa position, the floating cross tube 54 has moved even further from its original position (to the right as illustrated in FIG. 4) causing the sinuous wire springs 62 to expand even further. The plane defined by the middle of the floating cross tube 54 has moved to position P3 further increasing the tension on the sinuous wire springs 62. As seen in FIG. 4, the distance between the position of the floating cross tube 54 in FIG. 2 and the position of the floating cross tube 54 in FIG. 4 with the frame sections folded is identified as D2 which is greater than D1. The distance between the plane P3 and the end rail 36 of the foot frame section 22 is identified in FIG. 4 as L2 which is a distance greater than L1 by the distance D2.

Thus, the ability of the floating cross tube to move forwardly a distance D2 enables the sinuous wire springs to lengthen and therefore tighten when the frame sections are folded into a sofa position (see FIGS. 2–4) thus creating a more rigid seating surface for the user than if the sinuous wire springs 62 could not expand. In all heretofore known sofa sleeper foldable sofa bed assemblies employing sinuous spring seat sections, such as described in U.S. Pat. No. 4,584,727, the distance between the cross rail and the end rail of the foot frame section and, hence, the length of the sinuous wires does not change.

Another advantage of the floating cross tube 54 of the present invention illustrated in FIGS. 5 and 6 is that the floating cross tube 54 provides additional seating support for the user. When the frame sections 16, 18, 20 and 22 are folded in the sofa position, illustrated in FIG. 5, the front of the sofa seating surface is the cross rail 46. The floating cross tube 54 is located slightly rearwardly of the cross rail 46 and attached thereto by the two wire hooks 56. The floating cross tube 54 is able to move upwardly and downwardly, as illustrated in FIG. 6, a limited distance such that when a person sits on the seating surface, the floating cross tube moves from the position illustrated in solid lines in FIG. 6 downwardly to the position shown in dashed lines in FIG. 6. Rather than the user feeling like he or she is sinking downwardly below the cross rail 46, the floating cross tube 54 provides additional support in that the floating cross tube 54 only extends downwardly a fixed distance due to the fixed lengths of the wire hooks 56. Once the floating cross tube 54 has reached the position of the dashed lines in FIG. 6, it provides additional seating support in addition to the sinuous wire springs 62 and the fabric material 48.

In accordance with the practice of this invention and in order to maintain the spacing of the sinuous wire springs as well as distribute the load of a person seated on the sofa between them, there may be at least one straight connecting wire 68 (see FIG. 1) located between two adjacent sinuous wire springs 62 and connected at opposite ends to the sinuous wire springs by an eye (not shown) formed in each end of the connecting wire 68 as is conventional.

Figure 7:
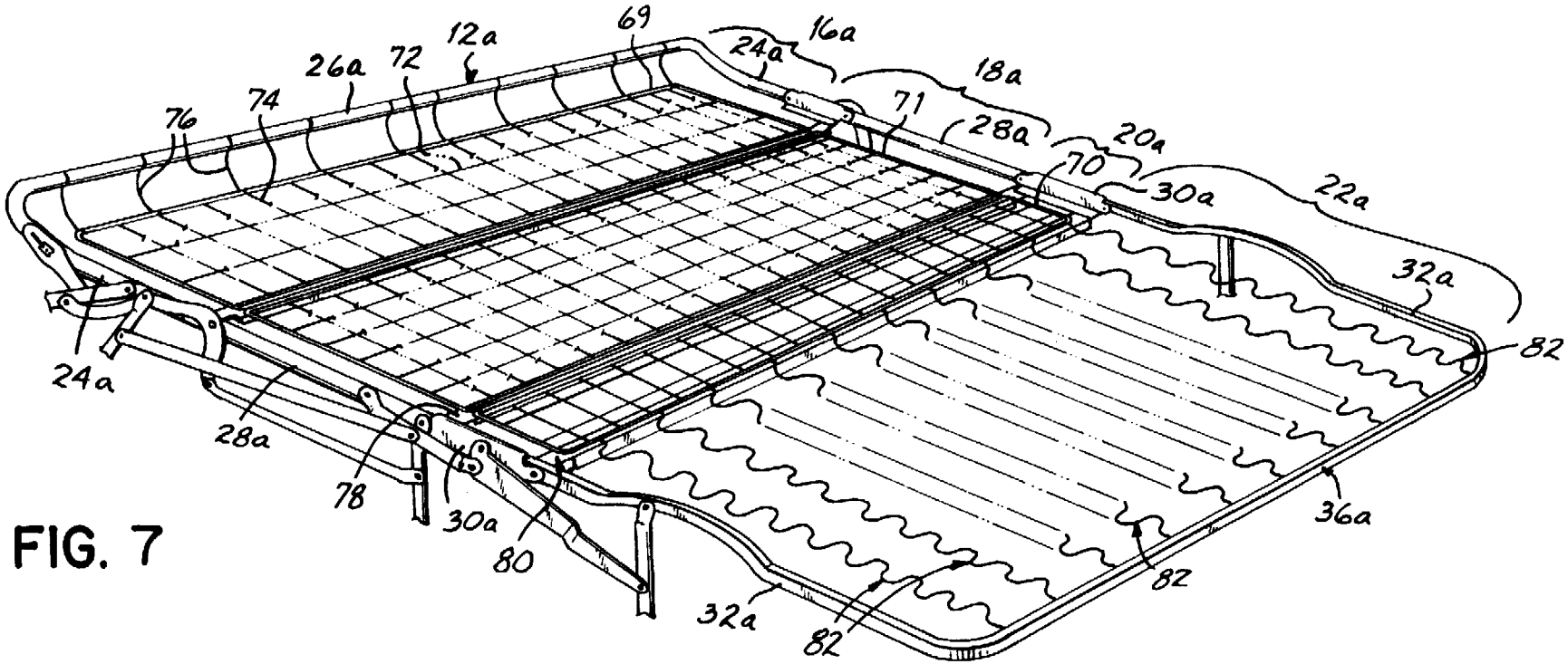
FIG. 7 is a perspective view of a second embodiment of the sofa bed assembly in which sinuous wire springs of the foot section extend between a cross rail and the end rail of the foot frame section.
Figures 8, 8A, 8B, 9, 10:
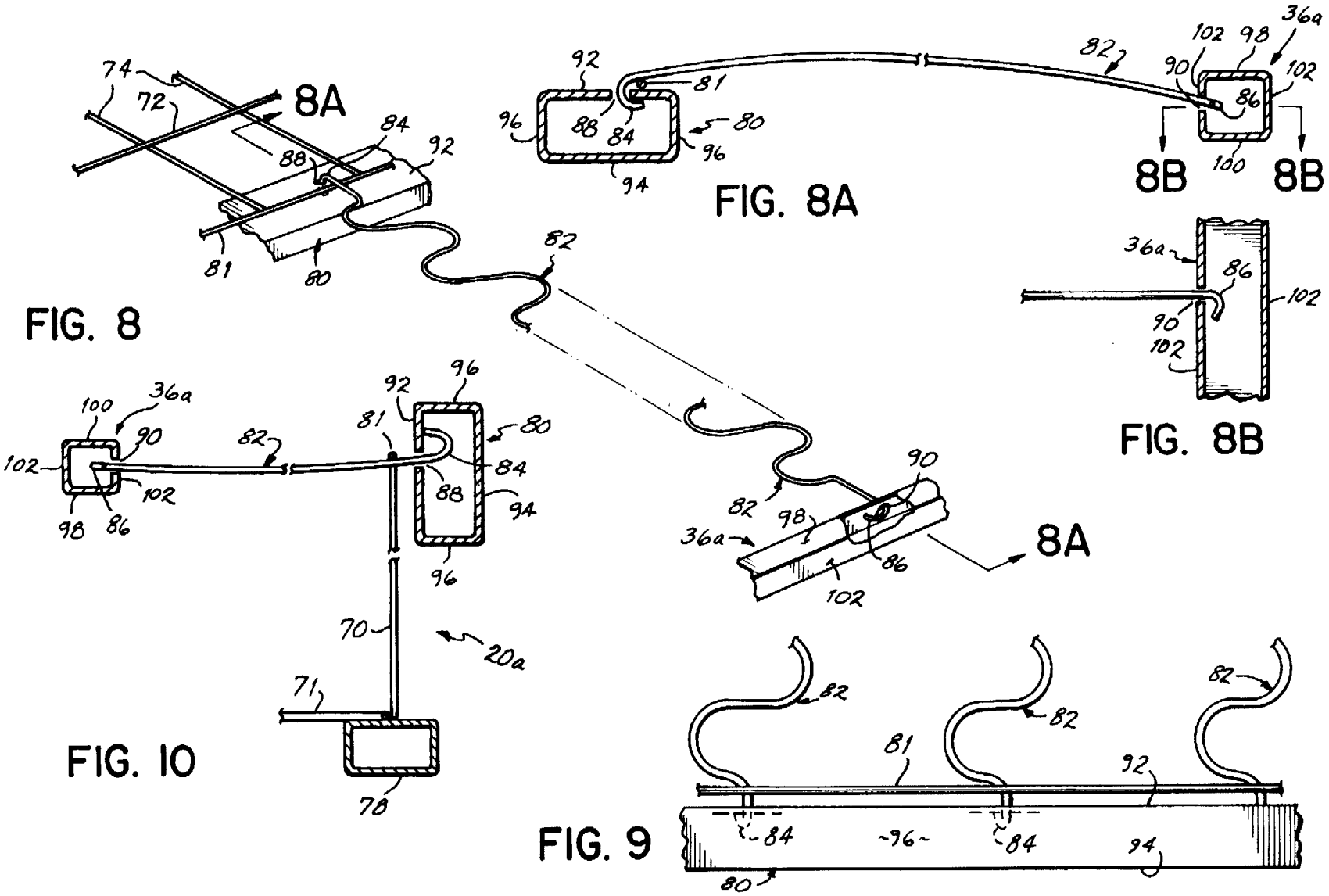
FIG. 8 is an enlarged perspective view of one portion of FIG. 7 illustrating the connection of one sinuous wire spring to the end rail and the cross rail.
FIG. 8A is a cross sectional view taken along the lines 8A—8A of FIG. 8.
FIG. 8B is a cross sectional view taken along the lines 8B—8B of FIG. 8A.
FIG. 9 is an enlarged top plan view of a portion of the cross rail of the intermediate frame section of the sofa bed assembly of FIG. 7 and the ends of a plurality of sinuous wire springs inserted therein.
FIG. 10 is a cross-sectional view, similar to FIG. 4, of the sofa bed assembly of FIG. 7 with the frame sections folded into the sofa position.

An alternative embodiment of the present invention is illustrated in FIGS. 7–10. The frame sections and linkage system are generally the same as in the embodiment of FIGS. 1–6. For the sake of simplicity, identical or similar parts in this alternative embodiment have been given the same numeral as the corresponding part in the first embodiment but the letter "a" has been added to distinguish the alternative embodiment from the first embodiment illustrated in FIG. 1–6. However, in this alternative embodiment, there is no fabric material 48 extending between the head and body supporting and intermediate sections of the frame and there is no floating cross tube. Rather, a plurality of substantially planar wire grids 69, 71, 70 extend across the length and width of the head, body supporting and intermediate frame sections respectively. Each grid comprises a plurality of transversely extending members 72 and a plurality of longitudinally extending members 74 arranged in a criss-crossing pattern. The wire grids 69, 71, and 70 may be attached to the frame sections 16, 18, 20 by coil springs or other conventional fasteners 76 as illustrated in FIG. 7. Two cross rails 78 and 80 respectively, connect opposite ends of the opposing side rails **30*a* of the intermediate frame section 20*a*, the cross rail 78 being located rearwardly of the cross rail 80. A plurality of transversely spaced longitudinally extending sinuous wire springs 82 extend between the front end rail 36*a* and the cross rail 80. As illustrated in FIG. 8, the forward most transversely extending wire 81 of the grid 70 lays directly on top of the cross rail 80 and is secured thereto by the sinuous wire springs 82 passing thereover. As illustrated in FIGS. 8, 8A and 8B, each sinuous wire 82 spring has a first substantially planar hook 84 at one end of the sinuous wire spring 82 engaged with the cross rail 80 and a second substantially planar hook 86 at the other end of the sinuous wire spring 82 engaged with the end rail 36*a*** of the foot frame section.

As best illustrated in FIGS. 8A and 8B, the first hook 84 of each sinuous wire spring 82 is substantially vertically oriented in a substantial vertical oriented plane and the second hook 86 is generally horizontally oriented in a generally horizontal plane. The first hook 84 extends through a hole 88 in the cross rail 80 and the second hook extends through a hole 90 in the end rail **36*a* of the foot frame section. The planar hooks 84, 86 of each sinuous wire spring 82 are located in mutually perpendicular planes such that when the frame sections 16*a*, 18*a*, 20*a* and 22*a* are extended in the bed position, the first hook 84 is substantially vertically oriented and the second hook 86** is substantially horizontally oriented.

As best illustrated in FIG. 8A, cross rail 80 and end rail **36*a* are generally hollow. The cross rail 80 is generally rectangularly shaped and when the frame sections are extended in the bed position, the cross rail 80 has a substantially planar top surface 92, a bottom surface 94 and two opposed side surfaces 96. The end rail 36*a* is generally square and has a top surface 98, a bottom surface 100 and two opposed side surfaces 102** when the frame sections are extended as shown in FIG. 8A.

When the frame sections are folded from the extended bed position shown in FIG. 8A into the sofa position shown in FIG. 10, with the foot frame section **22*a* being raised and moved rearwardly, the cross rail 80 rotates counterclockwise approximately 90° so that the top surface 92 is now located to the rear of the sofa (left in FIG. 10) and the bottom surface 94 is located to the front of the cross rail 80 (right in FIG. 10). Likewise, the end rail 36*a* is rotated approximately 180° and is essentially flipped over so that the bottom surface 100 of the end rail 36*a* becomes the top surface and the top surface 98 of the end rail 36*a*** becomes the bottom surface of the end rail.

The unique configuration of the attachment of the sinuous wire springs through a sidewall 102 in the end rail **36*a* and through the top surface 92 in the cross rail 80 enables the sinuous wire springs 82 to not twist or be unduly stressed as the frame sections move from the extended bed position to the foldable sofa position. Note that the forwardmost transversely extending grid wire 81, is located above the sinuous wire springs 82 when the frame sections are folded (see FIG. 10) whereas when the frame sections are extended in the bed position, the forwardmost transversely extending grid wire 81 is located below the sinuous wire springs 82** (see FIGS. 8 and 8A).

While the invention has been described with reference to two preferred embodiments, it will be understood that those skilled in the art may change certain elements and equivalents may be substituted for other elements without departing from the scope of the invention. In addition, modifications may be made to adapt to a particular situation or material without departing from the essential scope of the present invention. Therefore, it is intended that the invention is not to be limited to the particular embodiments disclosed but shall only be limited by the scope of the following appended claims.

I claim:

1. A sofa sleeper foldable sofa bed assembly having pivotally interconnected head, body, intermediate and foot frame sections each including a pair of opposed side rails, said foot and head frame sections having end rails connecting said side rails, a cross rail extending between said opposed side rails of said intermediate frame section, said frame sections being extendable to form a bed and foldable to form a sofa seat, a floating cross tube spaced from and parallel said cross rail, said floating cross tube having two ends, each end being secured to said cross rail, a plurality of transversely spaced, longitudinally extending sinuous wire springs extending between said floating cross tube and said end rail of said foot frame section.

2. The sofa sleeper foldable sofa bed assembly of claim 1 wherein each end of said floating cross tube is secured to said cross rail by a wire hook.

3. The sofa sleeper foldable sofa bed assembly of claim 1 wherein said floating cross tube is located forward of said cross rail when said frame sections are extended to form a bed and rearwardly of said cross rail when said frame sections are folded to form a sofa seat.

4. The sofa sleeper foldable sofa bed assembly of claim 1 further comprising substantially straight wires interconnecting adjacent ones of said sinuous wire springs.

5. The sofa sleeper foldable sofa bed assembly of claim 1 wherein a first end of each sinuous wire spring comprises a hook engaged with a hole in said floating cross tube and a second end of each sinuous wire spring comprises a hook engaged with a hole in said end rail of said foot frame section.

6. A foldable sofa sleeper sofa bed assembly capable of extending from a folded sofa position to an extended bed position, said assembly having a generally rectangular frame comprising pivotally interconnected head, body, intermediate and foot frame sections each including a pair of opposed side rails, end rails connecting said opposed side rails of said head and foot frame sections, respectively, and a cross rail extending between said opposed side rails of said intermediate frame section, the improvement comprising:

a floating cross tube having two ends spaced from and parallel said cross rail, said ends of said cross tube being attached to said cross rail with wire hooks of a fixed length, each hook passing through a hole in an end of said floating cross tube and a hole in said cross rail, a plurality of transversely spaced, longitudinally extending sinuous wire springs secured to and extending between said floating tube and said end rail of said foot frame section.

7. The foldable sofa sleeper sofa bed assembly of claim 6 wherein said wire hooks are located just inside said side rails of said frame.

8. The foldable sofa sleeper sofa bed assembly of claim 6 wherein said floating cross tube is located slightly forward of said cross rail when said frame sections are extended to form a bed and rearwardly of said cross rail when said frame sections are folded to form a sofa seat.

9. The sofa sleeper foldable sofa bed assembly of claim 6 further comprising straight wires interconnecting adjacent ones of said sinuous wire springs.

10. The sofa sleeper foldable sofa bed assembly of claim 6 wherein a first end of each sinuous wire spring comprises a hook engaged with a hole in said floating cross tube and a second end of each sinuous wire spring comprises a hook engaged with a hole in said end rail of said foot frame section.

11. A sofa sleeper foldable sofa bed assembly having pivotally interconnected head, body, intermediate and foot frame sections each including a pair of opposed side rails, said foot and head frame sections having end rails connecting said side rails, a cross rail extending between said opposed side rails of said intermediate frame section, said frame sections being extendable to form a bed and foldable to form a sofa seat, a plurality of transversely spaced, longitudinally extending sinuous wire springs extending between said cross rail and said end rail of said foot frame section, each sinuous wire spring having a first substantially planar hook at one end of said sinuous wire spring engaged with said cross rail and a second substantially planar hook at the other end of said sinuous wire spring engaged with said end rail of said foot frame section, said planar hooks of each sinuous spring being located in mutually perpendicular planes such that when said frame sections are extended said first hook is substantially vertically oriented and inserted through a hole in the top of the cross rail and said second hook is substantially horizontally oriented and inserted through a hole in a sidewall of the end rail.

12. The sofa sleeper foldable sofa bed assembly of claim 11 further comprising straight wires interconnecting adjacent ones of said sinuous wire springs.

13. The sofa sleeper foldable sofa bed assembly of claim 11 wherein said cross rail is rectangular in cross section.

* * * * *